US006928675B2

(12) United States Patent
Hamilton

(10) Patent No.: US 6,928,675 B2
(45) Date of Patent: Aug. 16, 2005

(54) PILLOW COVER

(76) Inventor: Hugo Hamilton, 5477 Georgetown Trace, Lilburn, GA (US) 30047

( * ) Notice: Subject to any disclaimer, the term of this patent is extended or adjusted under 35 U.S.C. 154(b) by 0 days.

(21) Appl. No.: 10/757,103

(22) Filed: Jan. 14, 2004

(65) Prior Publication Data

US 2005/0150048 A1 Jul. 14, 2005

(51) Int. Cl.[7] ..... A47G 9/00
(52) U.S. Cl. ..... 5/490; 5/640; 5/632; 5/923
(58) Field of Search ..... 5/490, 636, 644, 5/645, 482, 501, 632, 923, 640

(56) References Cited

U.S. PATENT DOCUMENTS 1,710,520 A * 4/1929 Rozalia ..... 5/490
4,231,125 A * 11/1980 Tittl ..... 5/419
4,763,369 A * 8/1988 Spector ..... 5/640
4,876,755 A * 10/1989 Parrish ..... 297/284.3
5,157,799 A * 10/1992 Aird ..... 5/490
5,566,410 A * 10/1996 Schaechter ..... 5/490
5,839,138 A * 11/1998 Weidman et al. ..... 5/636
5,904,406 A * 5/1999 Stewart ..... 297/397
6,065,164 A * 5/2000 Swanger et al. ..... 5/420
6,367,105 B1 * 4/2002 Farley ..... 5/630
6,634,042 B2 * 10/2003 Blossman ..... 5/499

FOREIGN PATENT DOCUMENTS

CH 70118 * 2/1915

* cited by examiner

*Primary Examiner*—Alexander Grosz
(74) *Attorney, Agent, or Firm*—Barry E. Kaplan; Ashish D. Patel; Myers & Kaplan, LLC

(57) ABSTRACT

A pillow cover that can be quickly and effortlessly placed over and removed from a conventional pillow, thus facilitating as many changes and/or replacements of the pillow cover as desired.

8 Claims, 4 Drawing Sheets

PILLOW COVER

TECHNICAL FIELD

The present invention relates generally to bedding, and more specifically to a pillow cover functionally designed to easily receive and securely envelop any conventional pillow.

BACKGROUND OF THE INVENTION

Generally, a pillow cover functions as a protective barrier between an underlying pillow and the user's head, preventing the pillow from becoming soiled with head and/or facial dirt, sweat and/or natural oils. As such, many individuals frequently change and/or launder their pillow covers to maintain a hygienic and/or sanitary sleeping atmosphere.

Additionally, some individuals who are easily susceptible to common household allergens, such as dust, dust mites and/or exteriorly-introduced pollen, typically replace their pillow covers daily so as to reduce the likelihood of an allergic reaction and/or inflammation of mucousal tissue.

Unfortunately, however, such frequent replacement of pillow covers can become time-consuming and tedious. Additionally, as most individuals who have changed a pillow cover before have discovered, it is somewhat tasking to slide a pillow into a pillow cover, often requiring more physical force than anticipated.

Therefore, it is readily apparent that there is a need for a pillow cover that quickly and effortlessly receives and securely envelops a conventional pillow therein, thus facilitating frequent changes and/or replacement of the pillow cover as desired.

BRIEF SUMMARY OF THE INVENTION

Briefly described, in a preferred embodiment, the present invention overcomes the above-mentioned disadvantages, and meets the recognized need for such a device by providing a pillow cover that can be quickly and effortlessly placed over and removed from a conventional pillow, thus facilitating as many changes and/or replacements of the pillow cover as desired.

According to its major aspects and broadly stated, the present invention in its preferred form is a pillow cover having hook-and-loop fasteners.

More specifically, the present invention is a pillow cover having hook-and-loop, zipper, snap, hook, or button fasteners, or the like, strategically placed on the edges of two sides of the pillow cover, thus permitting the pillow cover to open for placement of a pillow therein, rather than the sliding of a pillow therein. Upon placing a pillow within the open pillow cover, the open sides of the pillow case are refastened via the hook-and-loop fasteners. In an alternate embodiment, the pillow cover further employs a drawstring to enable the secured enveloping of the pillow cover over the enclosed pillow.

Accordingly, a feature and advantage of the present invention is its ability to permit frequent quick and effortless pillow cover changes.

Another feature and advantage of the present invention is its ability to be manufactured to receive any size pillow.

Yet another feature and advantage of the present invention is its ease of use.

Still another feature and advantage of the present invention is its simplicity of design.

Still yet another feature and advantage of the present invention is its ability to be adapted/altered to allow utilization thereof over most any type of pillow.

These and other features and advantages of the present invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figures, in which like reference numerals denote similar structures and refer to like elements throughout, and in which.

DETAILED DESCRIPTION OF THE PREFERRED AND ALTERNATIVE EMBODIMENTS

In describing the preferred and alternate embodiments of the present invention, as illustrated in FIGS. 1–3A, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
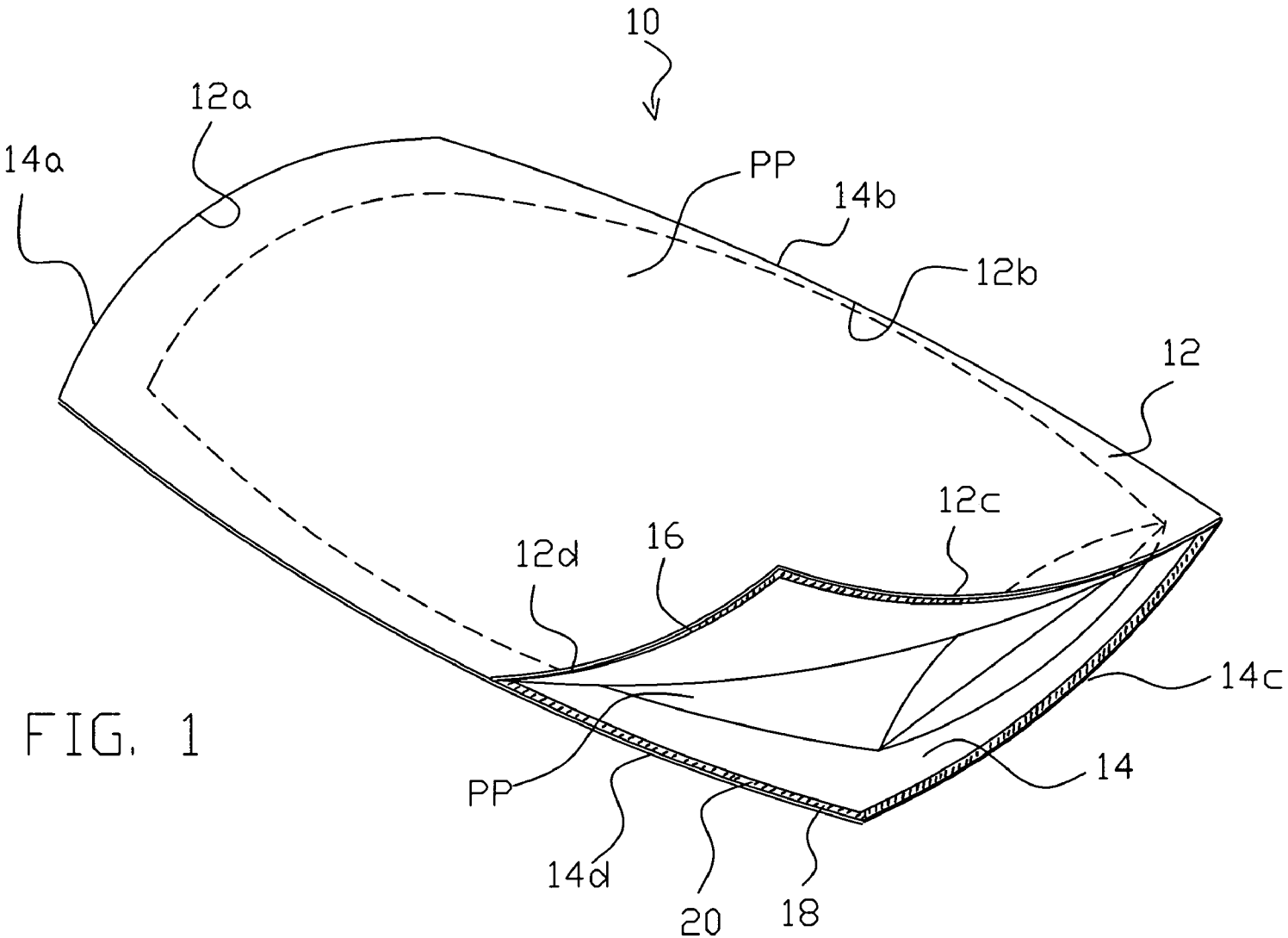
FIG. 1 is a perspective view of pillow cover according to a preferred embodiment of the present invention.

Referring now to FIG. 1, the present invention in its preferred embodiment is a pillow cover 10 having first side 12, second side 14, hook fastener portion 16 and loop fastener portion 18 of hook-and-loop fastener 20, wherein pillow cover 10 is substantially rectangular-shaped and formed from suitable material as known within the art. Although the preferred shape of pillow cover 10 is rectangular, it is contemplated in an alternate embodiment that pillow cover 10 could possess any desired shape.

Preferably, first side 12 possesses edges 12*a*, 12*b*, 12*c* and 12*d*, and second side 14 possesses edges 14*a*, 14*b*, 14*c* and 14*d*, wherein edges 12*a*, 14*a*, and edges 12*b*, 14*b*, are preferably joined so as to form closed ends. Preferably affixed along the entirety of edges 12*c*, 12*d* is hook fastener portion 16 of hook-and-loop fastener 20. Hook fastener portion 16 is preferably aligned with and fastenable to loop fastener portion 18 of hook-and-loop fastener 20, wherein loop fastener portion 18 is preferably affixed along the entirety of edges 14*c*, 14*d*. Upon placing a pillow PP between first side 12 and second side 14 of pillow cover 10, edges 12*c*, 12*d* of first side 12 are preferably brought into contact with edges 14*c*, 14*d*, respectively, of second side 14, thus permitting first side 12 and second side 14 to fully envelop pillow PP. Although hook-and-loop fastener 20 is preferably utilized to secure pillow cover 10 around a conventional pillow, it is contemplated in an alternate embodiment that zippers could be utilized instead and/or in combination therewith.

Figure 2:
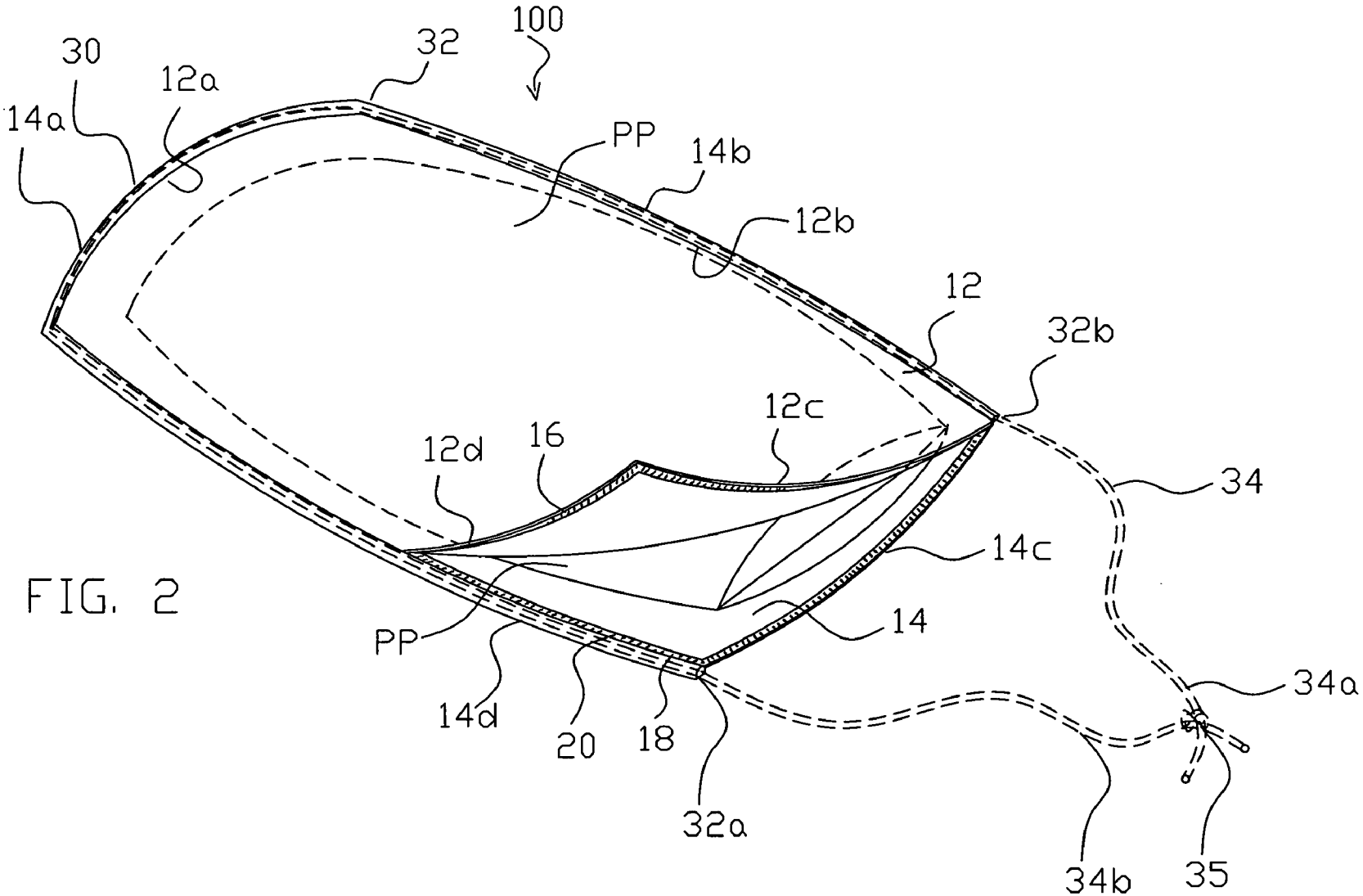
FIG. 2 is a perspective view of pillow cover according to an alternate embodiment of the present invention.

Referring now to FIG. 2, the present invention in an alternate embodiment is a pillow cover 100 having first side 12, second side 14, hook fastener portion 16 and loop fastener portion 18 of hook-and-loop fastener 20, and drawstring mechanism 30, wherein pillow cover 100 is substantially rectangular-shaped and formed from suitable bedding material as known within the art.

First side 12 possesses edges 12*a*, 12*b*, 12*c* and 12*d*, and second side 14 possesses edges 14*a*, 14*b*, 14*c* and 14*d*, wherein edges 12*a*, 14*a*, and edges 12*b*, 14*b*, are joined so as to form closed ends. Affixed along the entirety of edges 12*c*, 12*d* is hook fastener portion 16 of hook-and-loop fastener 20. Hook fastener portion 16 is aligned with and fastenable to loop fastener portion 18 of hook-and-loop fastener 20, wherein loop fastener portion 18 is affixed along the entirety of edges 14*c*, 14*d*.

Formed along the entirety of edges 14*a*, 14*b* and 14*d* of second side 14 is enclosed channel 32 of drawstring mechanism 30, wherein enclosed channel 32 possesses exits 32*a*, 32*b* formed proximal edge 14*c* of second side 14. Positioned within enclosed channel 32 is drawstring 34 of drawstring mechanism 30, wherein ends 34*a*, 34*b* of drawstring 34 extend outwardly from exits 32*a*, 32*b*, respectively, of enclosed channel 32, and are knotted together via knot 35. It will be apparent to one ordinarily skilled in the art that the above-referenced drawstring arrangement might similarly extend from either or any of sides 14*a*, 14*b*, 14*c*, and/or 14*d*.

Upon placing a pillow PP between first side 12 and second side 14 of pillow cover 10, edges 12*c*, 12*d* of first side 12 are preferably brought into contact with edges 14*c*, 14*d*, respectively, of second side 14, thus permitting first side 12 and second side 14 to fully envelop pillow PP. Although hook-and-loop fastener 20 is preferably utilized to secure pillow cover 10 around a conventional pillow, it is contemplated in an alternate embodiment that zippers, buttons, snaps, hooks, and/or other well-known fabric fastening mechanisms could be utilized instead thereof and/or in combination therewith. Thereafter, drawstring 34 is utilized to tighten first side 12 and second side 14 around the underlying pillow PP via pulling on knot 35 of drawstring 34.

Figure 3:
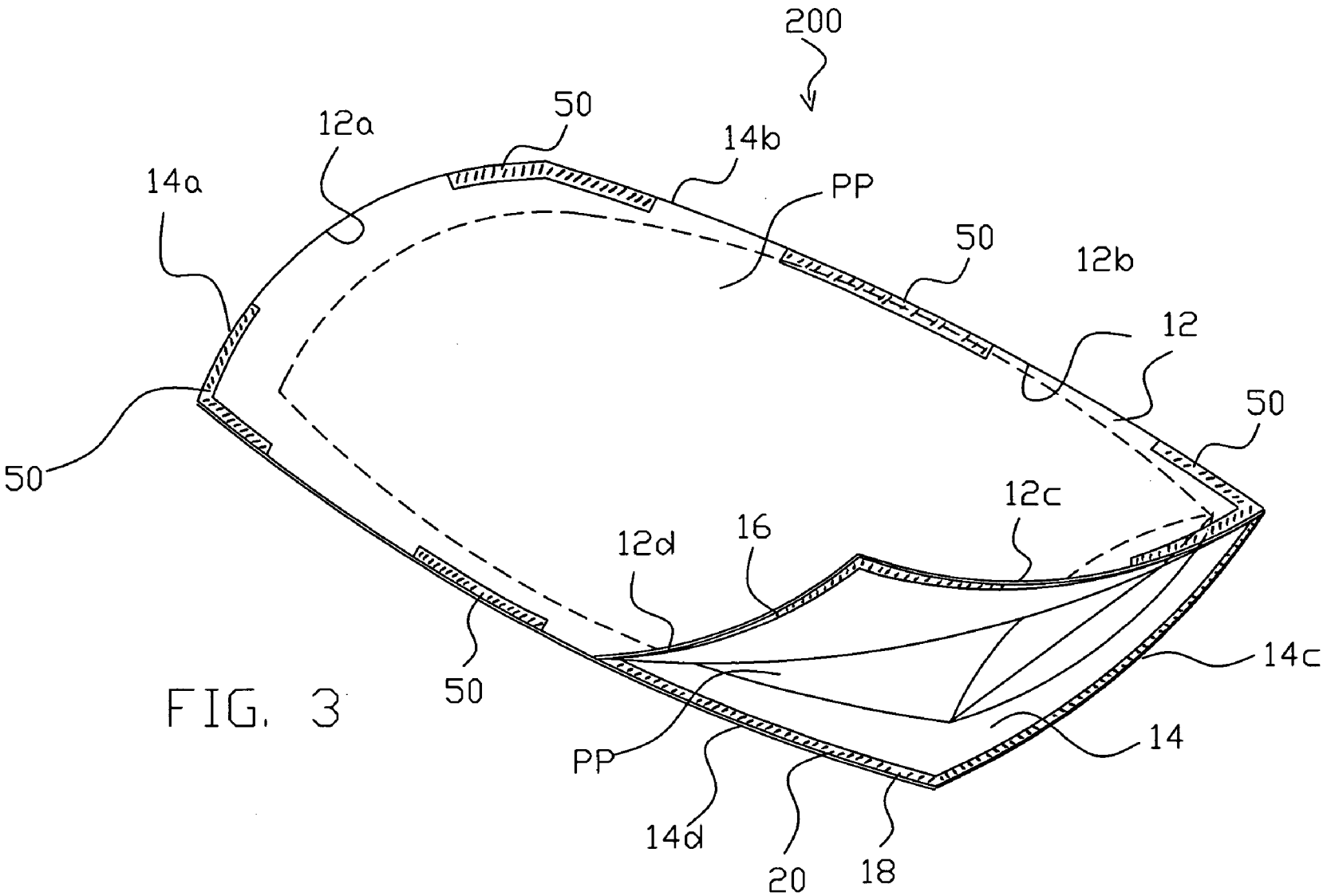
FIG. 3 is a perspective view of pillow cover according to an alternate embodiment of the present invention; and, FIG. 3A is a perspective view of pillow cover according to an alternate embodiment of the present invention, showing the pillow cover in use.
Figure 3A:
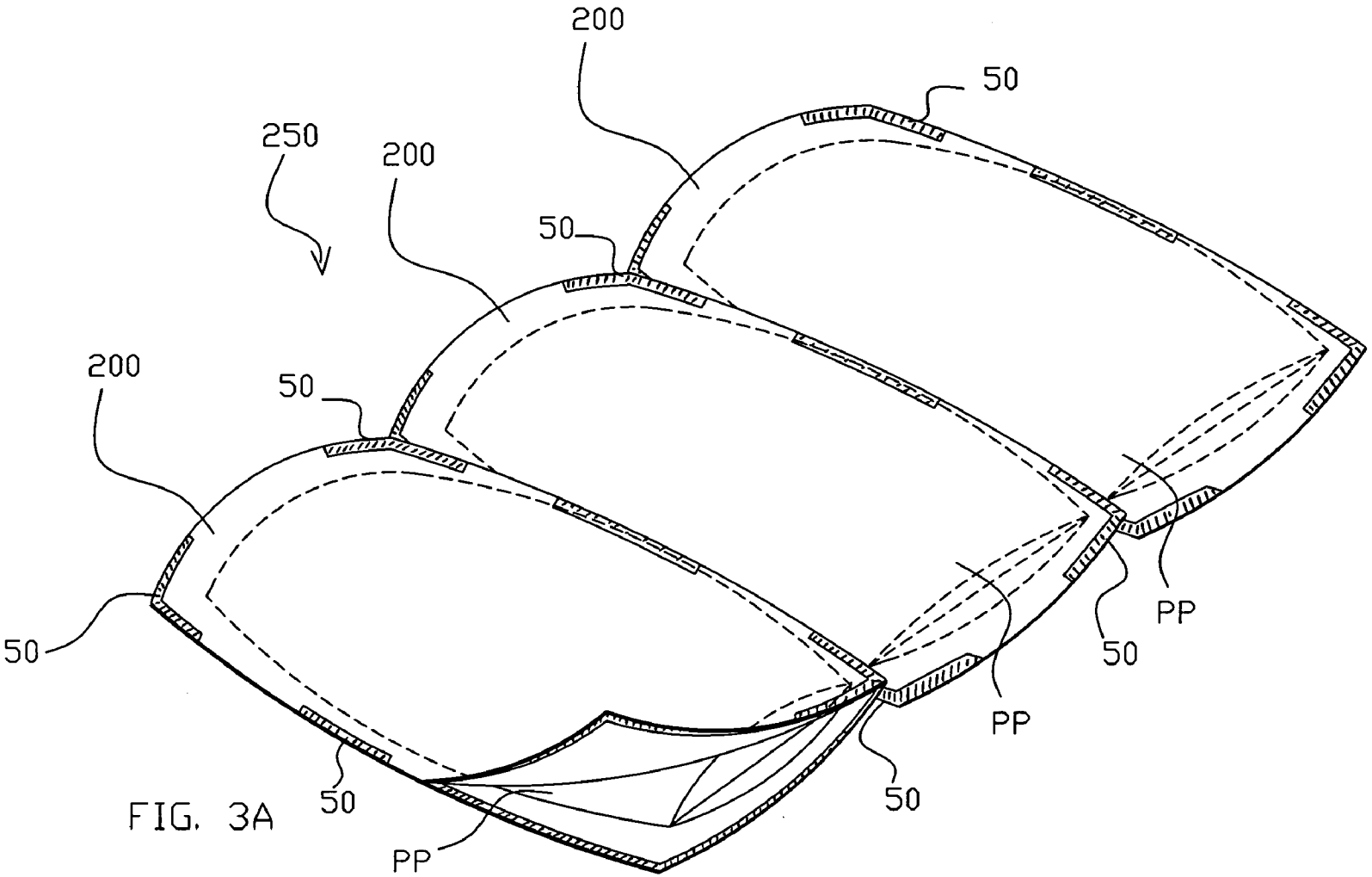

Referring now to FIG. 3, it is contemplated in an alternate embodiment that pillow cover 200, substantially similar in design to pillow cover 10, could possess hook-and-loop fasteners 50 affixed proximal to edges 12*a*, 12*b*, 12*c* and 12*d* of first side 12 and on outer surface 12*e* of first side 12, thus permitting a pillow-filled first pillow cover 200 to be attached in any arrangement to a pillow-filled second pillow cover 200 to yield bolster 250, as best illustrated in FIG. 3A. It is contemplated in yet another alternate embodiment that hook-and-loop fasteners 50 could be affixed proximal to any edge of pillow cover 200 to facilitate attachment of a plurality of pillow-filled pillow covers 200 in any desired arrangement. Ancillary convenience items, such as cup holders, writing platforms, or the like, may be similarly affixed to one or more segments of bolster 250 for the use and benefit of the user.

It is contemplated in an alternate embodiment that hook-and-loop fasteners 20 of pillow covers 10 and 100, and hook-and-loop fastener 50 of pillow covers 200, could either be long strips or small sectional pieces.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A pillow cover, comprising:

a first side comprising an outer and an inner surface;

a second side comprising an outer and an inner surface;

said first and second sides affixed along first and second adjacent edges thereof;

a first detachable securing means for detachably securing said first side and said second side along third and fourth adjacent edges thereof; and, a drawstring disposed through a channel formed along said first, second and third edges of said first side, wherein said drawstring exits through a first and a second end of said channel, wherein said first and said second end of said channel are disposed proximate to said fourth edge of said first side.

2. The pillow cover of claim 1, wherein said first detachable securing means is a hook-and-loop fastener disposed along at least a portion of said inner surfaces of said first and second sides, adjacent to said third and said fourth edges thereof.

3. The pillow cover of claim 1, further comprising a second detachable securing means disposed over at least a portion of said outer surfaces of said first side or said second side.

4. The pillow cover of claim 3, wherein said second detachable securing means of a first pillow-filled said pillow cover is detachably securable to said second detachable securing means of at least one other pillow-filled said pillow cover, thereby providing a bolster or other cushioned support.

5. The pillow cover of claim 3, wherein said second detachable securing means is a hook-and-loop fastener.

6. The pillow cover of claim 1, further comprising a second detachable securing means disposed along at least a portion of said outer surfaces of said first side or said second side adjacent to at least one of said edges thereof.

7. The pillow cover of claim 6, wherein said second detachable securing means of a first pillow-filled said pillow cover is detachably securable to said second detachable securing means of at least one other pillow-filled said pillow cover, thereby providing a bolster or other cushioned support.

8. The pillow cover of claim 1, wherein pulling of said drawstring results in constriction of said first, second and third edges of said first side and said second side, thereby constricting said first and said second side around a pillow disposed therebetween.

* * * * *